United States Patent [19]

Bianchi et al.

[11] 4,277,007

[45] Jul. 7, 1981

[54] FRONT OPENING HOLSTER FOR PISTOLS

[75] Inventors: John E. Bianchi; Richard D. E. Nichols, both of Fallbrook, Calif.

[73] Assignee: Bianchi Leather Products, Inc., Temecula, Calif.

[21] Appl. No.: 11,418

[22] Filed: Feb. 12, 1979

[51] Int. Cl.[3] ..... F41C 33/04

[52] U.S. Cl. ..... 224/193; 224/244; 224/911

[58] Field of Search ..... 224/192, 193, 243, 244, 224/911

[56] References Cited

U.S. PATENT DOCUMENTS

| | | | |
|---|---|---|---|
| 1,191,339 | 7/1916 | Noye | 224/911 |
| 1,322,198 | 11/1919 | Morrison | 224/243 X |
| 1,635,984 | 7/1927 | Corriston | 224/244 |
| 1,750,139 | 3/1930 | Swift | 224/911 |
| 1,851,352 | 3/1932 | Denkert | 224/911 |
| 1,917,844 | 7/1933 | Keith | 224/244 X |
| 1,930,203 | 10/1933 | Jewett | 224/193 |
| 2,349,376 | 5/1944 | Ray | 224/911 |
| 3,804,306 | 4/1974 | Azurin | 224/243 X |
| 4,035,902 | 7/1977 | Bianchi et al. | 224/193 X |

*Primary Examiner*—Stephen Marcus

*Attorney, Agent, or Firm*—Wagner & Bachand

[57] ABSTRACT

A front opening holster for semi-automatic and other pistols. The holster includes a body of leather formed into a U-shaped pocket with the base of the U located at the rear. The body is maintained in a weapon holding shape and the front opening formed by the ends of the U held closed by a pair of sheet metal spring members held together at the rear of the holster by a spacer block. The top of the spacer provides a rest and stop for the trigger guard of the weapon. A cantilevered spring member carrying a shaped locking member is secured to the holster body on one side. A relatively rigid backing plate is positioned on the opposite side of the holster body. The shaped locking member when engaged by the trigger guard moves out of the way to allow the trigger guard to pass. A restraining strap allows the spring member and locking members to deflect outward and rearward but not in the forward direction.

19 Claims, 21 Drawing Figures

FIG. 1
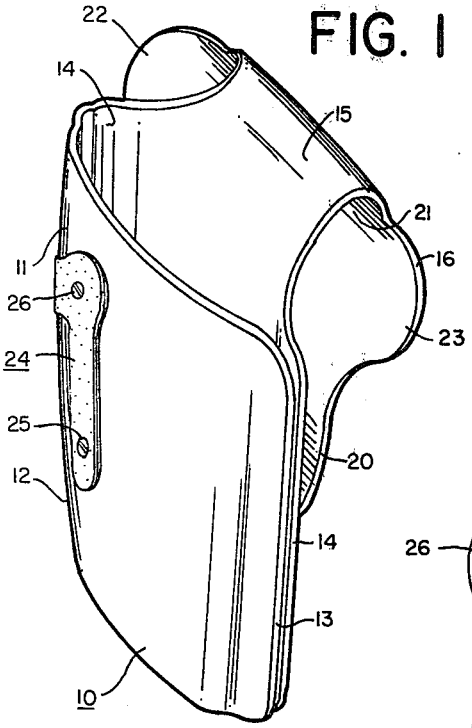
FIG. 9
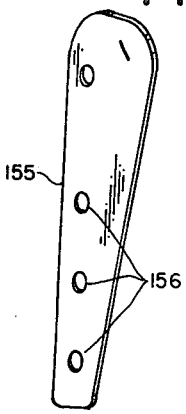
FIG. 10
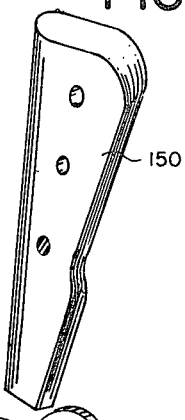
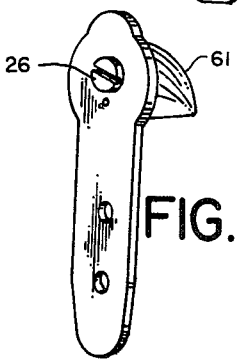
FIG. 8
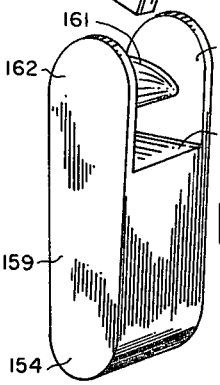
FIG. 11
FIG. 13
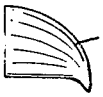
FIG. 15
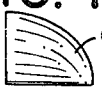
FIG. 14
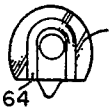
FIG. 12
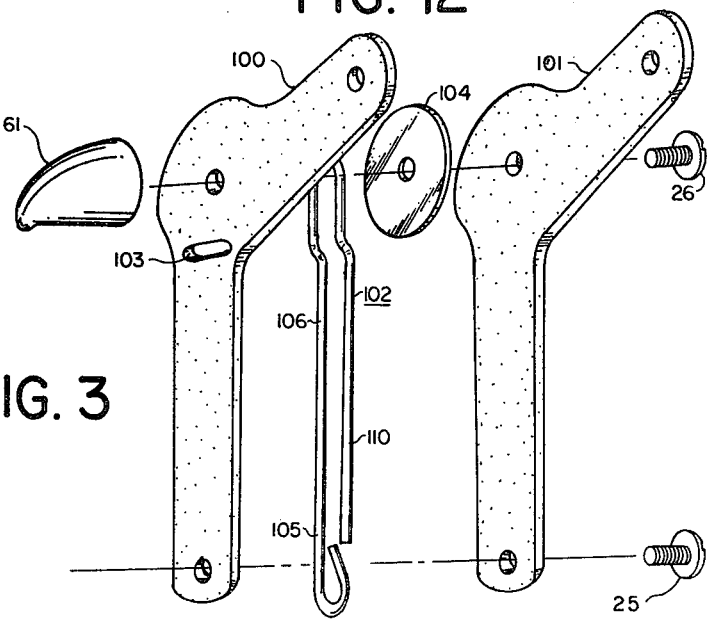
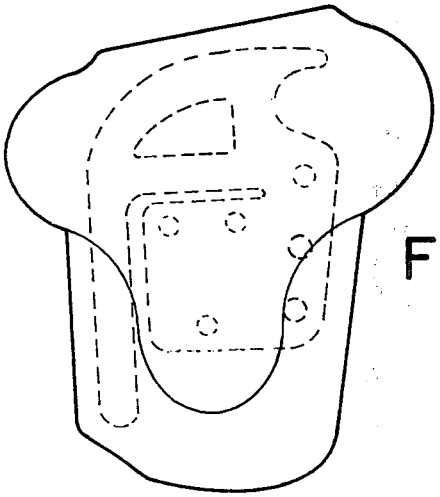
FIG. 3

FRONT OPENING HOLSTER FOR PISTOLS

BRIEF STATEMENT OF THE INVENTION

We have invented a front opening holster for semiautomatic and other handguns which provides:

(a) easy insertion of the handguns from the top;
(b) effective holding of the handgun in place;
(c) resistance to withdrawal from the top;
(d) natural removal of the weapon frontward;
(e) relatively uniform pressure on the weapon in front drawing;
(f) a lock and release mechanism which is simple and easy to maintain;
(g) incorporates a novel front closing spring;
(h) incorporates a novel combination holster stiffener and spring assembly for weapon locking and release.

We believe that these advantages have been obtained for semi-automatic and other handguns lacking protruding cylinders. All is accomplished in a holster which comprises a body of leather-like material folded at the rear to define a pistol-carrying cavity and having front, top, and bottom openings. The rear folded portion of the holster is stiffened and held together by a block which also spaces a pair of concave sheet metal springs which serve to define the weapon cavity and provide closing force and controlled opening of the front opening upon drawing of the weapon.

The spacer block includes a shelf against which the front of the trigger guard rests when the weapon is properly positioned in the holster.

A novel weapon lock for holding the weapon in place while allowing its easy insertion from the top and removal only frontward is employed. It includes a leaf or wire form spring secured to the holster body carrying a shaped locking member which enters the trigger guard when the weapon is in place. The shaped locking member includes two tapered surfaces, one to allow insertion of the weapon from the top only, a second to allow withdrawal towards the front only.

BRIEF DESCRIPTION OF THE DRAWINGS

This invention may be more clearly understood from the following detailed description and by reference to the drawing in which:

FIG. 1 is a perspective view of the holster in accordance with this invention;

FIG. 3 is a rear view of the holster of FIG. 1 with the body spring element shown in dashed lines to illustrate its position;

FIG. 8 is a perspective view of a leaf spring assembly of this invention;

FIG. 9 is a perspective view of the backing plate of this invention;

FIG. 10 is a perspective view of the spacer block of this invention;

FIG. 11 is a perspective view of an alternate embodiment this invention showing in unitary form the elements making up FIGS. 8 through 10;

FIG. 12 is an exploded view of the preferred form of locking spring of this invention;

FIGS. 13–15 illustrate alternate forms of locking fingers of this invention;

DETAILED DESCRIPTION OF THE INVENTION

Figure 2:
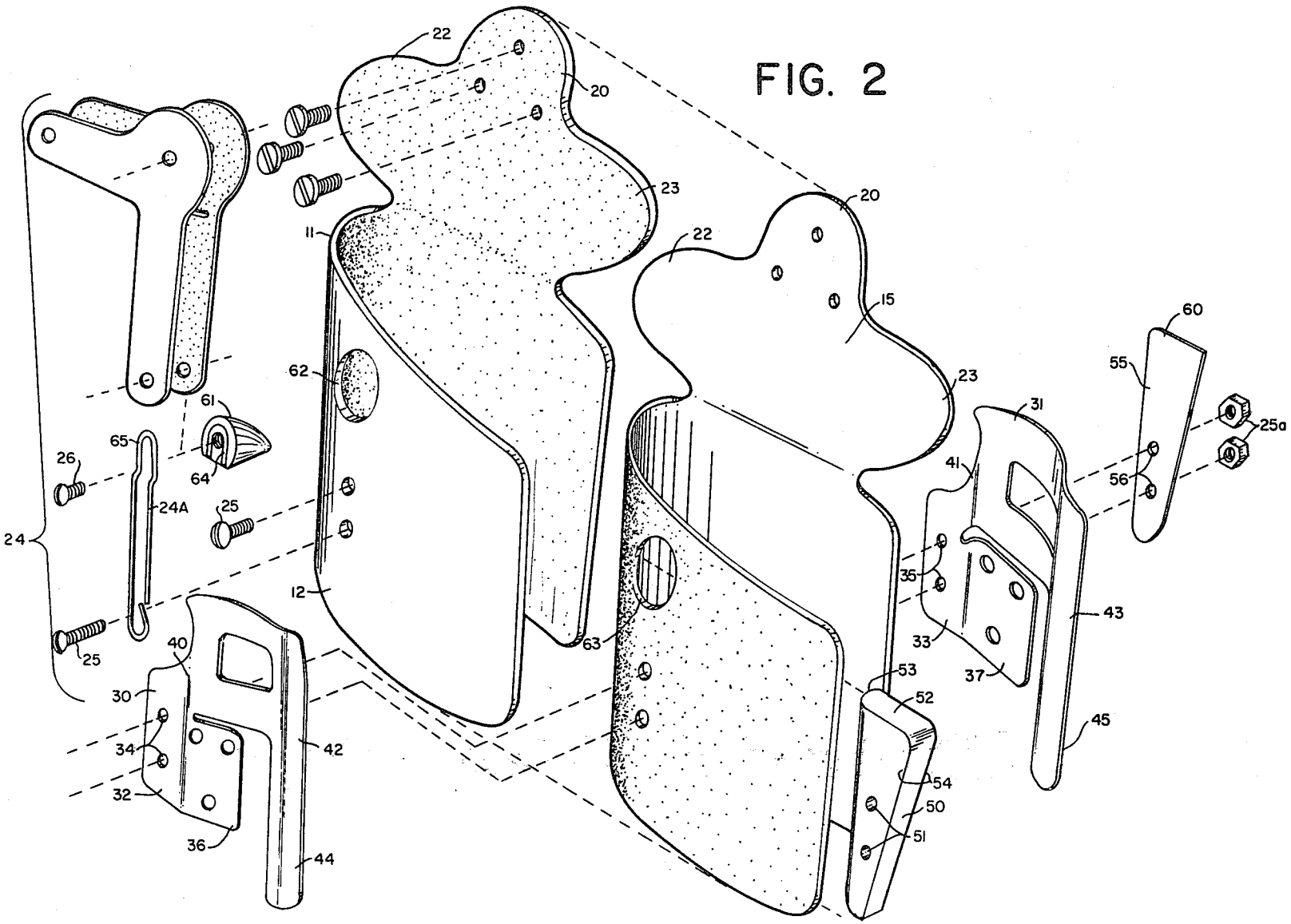
FIG. 2 is an exploded view of the holster of FIG. 1.

Now referring to FIG. 1, one may see a perspective view of one particular form of holster incorporating this invention. The holster 10 includes a rear fold portion 11 of the holster body 12 which has a pair of front edges 13A and 13B closely aligned together and constituting the front opening for the holster. A top opening 14 is used for placement of a semi-automatic handgun such as a Colt .45 caliber Government model. The holster in this embodiment is shown as including a lining 15 which becomes the outer surface of an integral belt loop 16 having a lower extension 20 secured to the rear face of the holster body 12 behind the edge 14. The integral belt loop 16 includes belt loop opening 21 and a pair of wing portions 22 and 23 which serve to conform the holster to the body of the wearer and provide broader area for transfer of load of the holster 10 to the wearer's belt.

As described above, the holster 10 appears to be like a number of front opening holsters built in accordance with our patents referenced above. One apparent difference exists and that is related to the fact that the holster 10 is designed for carrying any type of handgun which does not include any cylinder and consequently the holster does not include cylinder recesses and stops for holding the weapon in the holster as in previous patents. A different form of weapon locking arrangement is present in this invention and part of that system is visible in FIG. 1. It includes a locking spring assembly 24 secured to the body 12 by one or more fasteners such as machine screws 25. The spring assembly 24 is secured at its lower region by screws 25 and is mounted to flex from the plane of the holster body, as will be described hereinafter.

Figure 7:
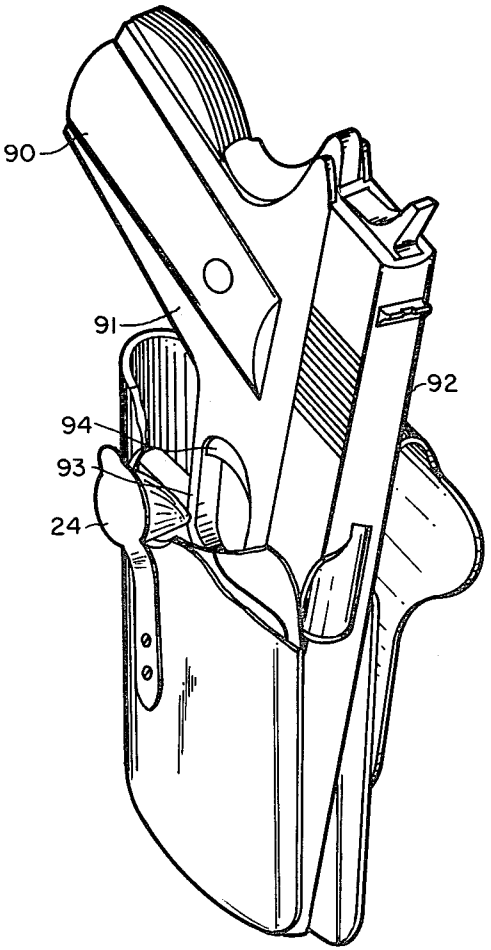
FIG. 7 is a perspective view of the holster of this invention partly broken away for clarity in the process of being withdrawn.
Figure 4:
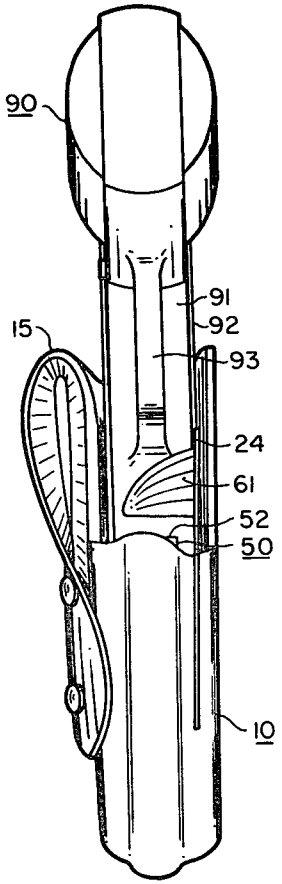

The upper end of the spring assembly 24 includes an additional fastener or screw 26 used to hold a locking member, unshown in FIG. 1 but seen in FIGS. 2, 4 and 7 and in particular the assembly is best seen in FIG. 12. Except for the assembly 24, all of the weapon locking elements of the invention are concealed within the holster. Also, within the scope of the invention is the arrangement with the spring assembly 24 and its associated locking member, located on the inner face of the holster body 12 rather than the outer face as shown here for convenience of understanding.

Suffice it to say, whether the spring assembly 24 is located on the outer or the inner face of the holster body 12, it cooperates with the remainder of the elements of the holster to provide effective holding and locking of a semi-automatic handgun in the holster by locking through the trigger guard. This is in contrast with our copending application, Ser. No. 011,420, filed Feb. 2, 1979, in which a hold-down finger enters the trigger guard but does not prevent upward drawing.

The various elements making up the holster may be more clearly seen in the exploded view in FIG. 2. Now referring to FIG. 2, the liner 15 of top grain or suede leather, may be seen as exploded from the holster body 12. Normally located between the liner 15 and the body 12 are a pair of formed sheet metal springs 30 and 31, each a mirror image of the other. The spring members 30 and 31 each include a planar portion 32 and 33 respectively having a pair of holes 34 and 35 respectively positioned to align with similar holes in a spacer block 50 described below, and in turn aligned with fasteners 25. The spring members 30 and 31 also include shaped tab portions 36 and 37 which constitute mounting plates for securing the extension 20 when it forms the belt loop. The mounting holes in plate 36 are only used for left hand holsters as opposed to the right hand version shown. The upper apertured portion of spring members 30 and 31 beyond bends 40 and 41, define the main body cavity shape of the holster. It is configured to the particular model of handgun to be carried. The tab portions 36 and 37 are relatively independent of the body with formed spring portion 30 which may flex outward. The portions each include a depending leg, 42 and 43 respectively, which corresponds in length generally to the length of the front opening of the holster. The spring members 30 and 31 as so designed, exhibit bending around the flexure portions 40 and 41 by outwarding bending to allow the weapon to be removed through the front of the holster. The fact that the depending legs 42 and 43 have free ends 44 and 45 respectively, allows a degree of outward bending in the leg portions 42 and 43. This facilitates opening of the holster toward the bottom to minimize what is sometimes termed "muzzle drag" in front opening holsters. Thus, the resistance to opening is less at the bottom of the holster than at the top and mid-region. The positioning of the springs 30 and 31 in the holster is illustrated in FIG. 3 where they appear as dashed lines. A free end spring has previously been disclosed in our U.S. Pat. No. 3,977,583 employing round spring wire. We have now found that the unitary spring members 30 and 31 of this invention provide multiplicity of functions with a minimum additional thickness added to the holster. They provide effective front closure and at the same time allow front drawing of semi-automatic handguns with a minimum of muzzle drag. Selective resistance to opening may be controlled by the presence or absence of bends from the plane of the flat spring such as bends in legs 42 and 43. This selective bending feature is difficult if not impossible to achieve in wire springs.

The spring members 30 and 31 are held in spaced relationship by the spacer 50 which has a pair of mounting holes 51 through which the fasteners 25 extend and further includes a top shelf 52 which acts as a stop for the trigger guard of the handgun carried in the holster as will be hereinafter described in more detail. The spacer 50 has a rounded rear surface 53 and pair of generally parallel side surfaces 54, each of which define the shape and spacing of the body parts defining the handgun cavity. The spacer 50 preferably is of plastic material with sufficient rigidity and durability for many years service.

FIG. 2 shows an additional element which is likewise secured by fasteners 25 adjacent to the spring member 31, that is a backing plate 55 which is of sheet metal. Plate 55 includes a pair of holes 56 corresponding to the holes 34 and 35 in the body spring members 30 and 31 and includes an enlarged upper end 60, the purpose of which is more apparent from the description of FIGS. 4–7 below. Plate 55 provides rigidity for the inner surface of the holster opposite a spring assembly 24 preventing any unwanted twisting of the handgun on holstering or drawing, particularly drawing. The backing plate 55 does not interfere with the spring action of the body spring member 31 since it is secured to the spring member 31 at its fixed plane at holes 34 and 35. Mating nuts 25A for the fasteners 25 holding the spacer 50, springs 30 and 31 and backing plate together in one assembly, appear adjacent to the backing plate 55.

The locking element for the handgun in the holster is visible for the first time in FIG. 2. It constitutes a finger 61 which is secured to a spring 70 by fastener 26 and extends through matching openings 62 and 63 in the body 11 and liner 15 respectively. The locking member or finger 61 includes U-shaped groove 64 molded into the flat base thereof to match alignment region 65 in the upper end of the spring 24A. Alignment region 65 prevents rotation of the finger 61 due to the entrance and exit forces applied to that member as the weapon is holstered and drawn. The preferred shapes of the finger 61 appears in the several views of FIGS. 13 through 15 to which reference is now made. The finger 61 may include a hook shaped lower surface as shown in FIG. 13 for locking the handgun from removal from the top, or an inclined surface as shown in FIG. 15 with the lowermost extent at its free end. The hook may be centered as shown in FIG. 13 or to one side as shown in FIG. 14.

Referring again to FIG. 2, the finger 61 extends through mated openings 62 and 63 in the body or shell 12 and liner 15. The finger 61 extends above the shelf 52 of spacer block 50 by an amount equal to the thickness of the front of the trigger guard of the weapon to be carried plus suitable clearance.

The spacer block 50 prevents removal downward. The backing plate 55 having greater resistance to bending than the spring 24A is located on the side opposite the spring 24A so that drawing of the handgun causes a deflection of the spring 24A without twisting of the handgun on drawing.

The main body spring assembly of block 50 and springs 30 and 31 holding the front opening, exhibits novel features in that it forms the weapon pocket as well and provides significantly less additional thickness to the holster than the wire springs employed heretofore.

Figure 6:
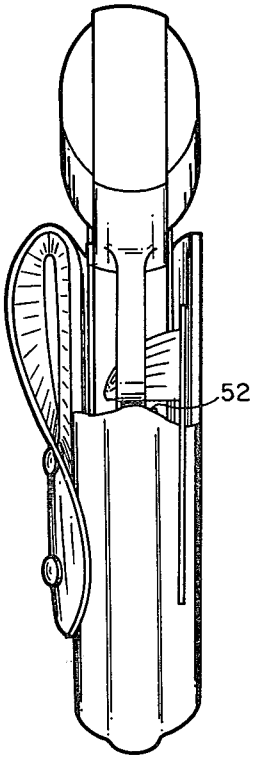
FIG. 6 is a rear view similar to FIG. 4 with the automatic weapon in carrying position.
Figure 5:
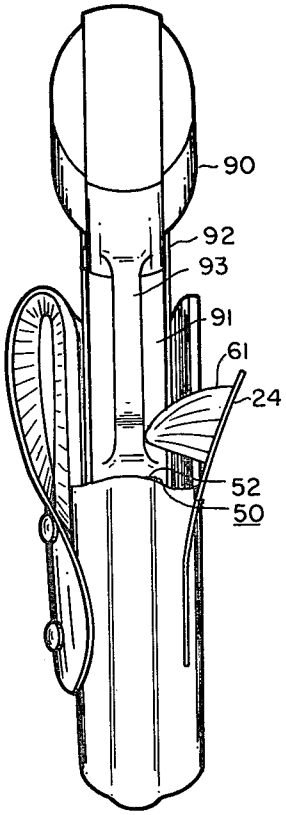
FIG. 4 and 5 are rear views of the holster of this invention partly broken away illustrating the holster with an automatic weapon in the process of being inserted from the top.

When an automatic handgun is inserted from the top as illustrated in FIGS. 4–6, the front of the trigger guard 93 bearing upon the upper curved surface of finger 61 drives the finger 61 and spring assembly 24 outward sufficiently for the front of the trigger guard 93 to pass. The finger 61 then snaps back into place and the handgun is prevented from being drawn upward by the positive locking of finger 61. It may not be removed by twisting because of the cooperation of the stiff backing plate 55 which acts like a fixed jaw while the finger 61 is a movable jaw. Upward pressure on the handgun causes closing pressure on the lock where the finger 61 is tapered as in FIG. 15.

An alternate embodiment incorporates the spacer, leaf springs, shaped locking member and blocking plate in one member, is disclosed in FIG. 11, and described below.

Refer now to FIGS. 4–7 for an illustration of the operation of this invention used with a semi-automatic handgun (FIGS. 4–7) and drawing the same handgun in FIG. 7.

A typical semi-automatic handgun generally designated 90 includes a frame 91, a slide 92 and a trigger guard 93 as well as a trigger 94 appearing only in FIG. 7. In FIG. 4 the handgun 90 has been inserted in the holster 10 from the top and is only partly seated. The front or bottom in FIG. 4 of the trigger guard 93 is about to contact finger 61. The curved upper surface of finger 61 provides an inclined bearing surface for smooth deflection of spring assembly 24 by the trigger guard 93 until it can clear the finger 61 as shown in FIG. 5. There, the end of the finger 61 bears against the side of trigger guard 93.

In FIG. 6, the trigger guard 93 has progressed beyond the point of the finger 61 and it has returned to its normal position, now locking the front of the trigger guard 93 between its lower surface and the shelf 52 of spacer block 50 which appears below finger 61 in each of these figures. Shelf 52 prevents further downward movement of the handgun 90 and prevents the finger 61 from contacting the trigger for safety sake.

Although finger 61 either is hooked (FIGS. 13, 14) flat (FIGS. 2, 4–7) or tapered as finger 61B (FIG. 15) on its underside to prevent upward removal, the back to front taper illustrated in each of the figures allows the handgun to be drawn by forward pressure applied to the grip. Such pressure deflects the spring assembly 24 and springs 30 and 31 outward as shown in FIG. 7. In this direction the additional force for operation of the spring assembly 24 has not been found to be objectionable and the handgun smoothly draws forward.

In FIGS. 4–7 the spring assembly of FIG. 8 is used for illustration purposes. The preferred embodiment for the spring assembly however is illustrated in FIGS. 1, 2 and 12.

Through extensive experimentation we have found that sheet metal springs 30 and 31 are preferred for the body springs controlling the front closure. These springs are subject to flexure in one direction at bends 40 and 41 respectively shown in FIG. 2, as the handgun emerges. Additionally, the legs 44 and 45 may flex outward in variable amounts as the handgun emerges. The contouring of springs 30 and 31 allows the control of stiffness as desired. We have found that spring steel of 1/32" thickness and having a width of approximately 5/8" at its narrowest bending section 40 and 41 has proved eminently satisfactory.

By way of contrast, a flat spring such as is shown in FIG. 8 for trigger guard lock is satisfactory but a wire spring form as illustrated in FIG. 12 is preferred. The spring assembly 24 is subject to side or edge as well as outward bending as the handgun is drawn. A flat spring such as is shown in FIG. 8 is virtually unyielding when loaded from an edge until it twists. The ratio between the bending forces in the flat to the edge direction is practically too great for a smooth reasonable force drawing of the weapon.

Employing the embodiments of FIGS. 1, 2, 12 and 16–19, controlled bending along two axes is achieved.

Referring now to FIG. 12, the preferred spring assembly comprises an inner leather cover 100, an outer cover 101, a spring of a discontinuous wire loop 102. The covers 100 and 101 include openings for fasteners 25 and 26. The fasteners 25 and 26 pass through the end loops of wire form 102. Note that the wire spring 102 has a discontinuity or break 105 which allows the two legs 106 and 110 to flex together or separately. The stiffness of the leather covers, 100 and 101, when stitched over the spring 102, provides additional stiffness to outward bending. The spring 102 includes an offset which coincides in position with a slot 103 in the inner cover 100. Spring 102 extends through slot 103 so that it is in direct contact with the finger 61, resting in groove 64 shown in FIGS. 2 and 12.

The break 105 in spring 102 allows the spring to twist subject to the torsional resistance only of leg 110 plus the leather covers 100 and 101. The spring assembly thus, upon drawing, allows the finger 61 and spring 102 to twist slightly to allow the trigger guard to pass smoothly frontward beyond the locking region.

Figure 16:
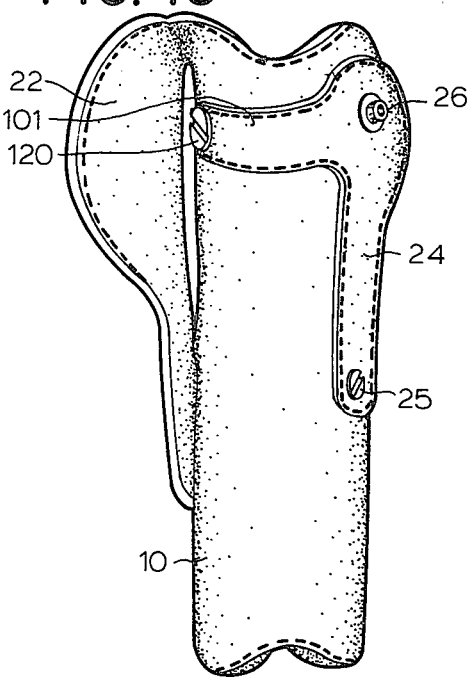
FIG. 16 illustrates the preferred embodiment of our holster as viewed from the rear as it would appear with semi-automatic handgun in place.
Figure 18:
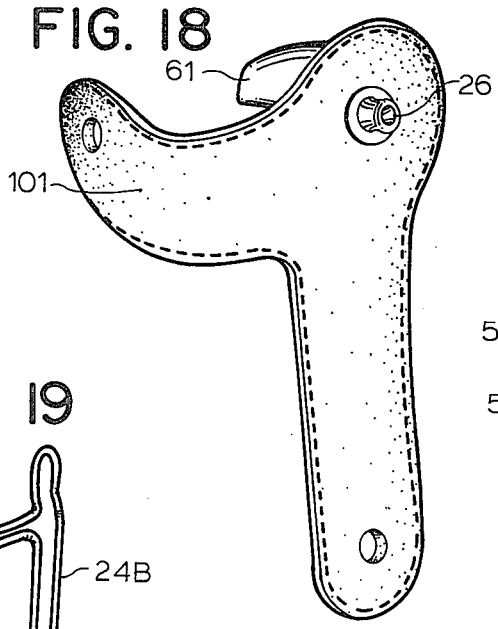
FIG. 18 is a perspective view of the spring and retainer assembly of FIGS. 16 and 17.

The arm portions 111 and 112 of the covers are stitched together and as shown in FIGS. 16 and 18, extend around the rear of the holster body and are secured by a fastener, unshown in FIG. 18 but appearing as fastener 120 in FIG. 16. The strap 111–112 prevents frontward loading upon the spring assembly all being absorbed by the fastener 25. Thus, the spring assembly affords effective outward springing of the finger, allows slight twisting to aid in releasing the trigger guard and further provides for positive restraint upon forward movement of the spring assembly 24 upon drawing of the handgun. Therefore, it is preferred.

Figure 17:
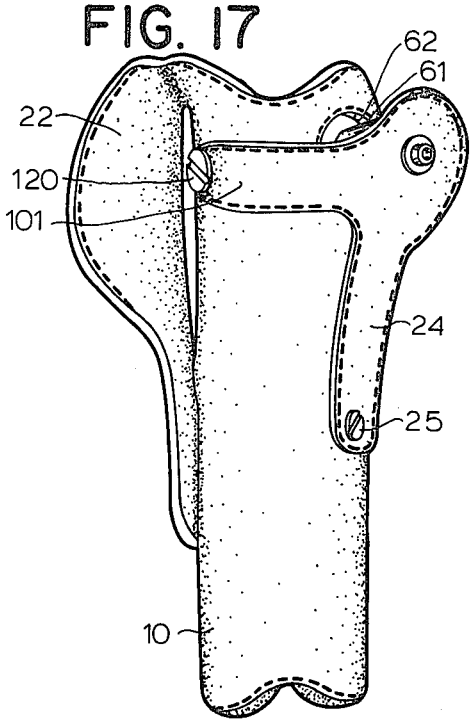
FIG. 17 is a view similar to FIG. 16 showing the holster of FIG. 16 as it would appear with the handgun partly drawn.

Now referring to FIGS. 16–18 illustrating the additional feature of this invention employing this spring assembly generally designated 24. Extending laterally across the back of the holster 10 is the strap 101 secured at its end by a screw fastener 120 which passes through the leather body and mates with an internal T-nut or other similar fastening device, unshown. This strap 101 extending across the back of the holster provides a restraining force against the spring assembly 24 preventing it from pivoting forward responsive to pressures of the trigger guard against the finger 61 as the hand gun emerges from the holster. This restraint produced by strap 101 cooperates with the spring assembly 24 to allow the finger 61 and spring 24 to pivot outward and rearward in the direction of the arrow in FIG. 17 without moving forward and engaging the edge of the hole 62. In the absence of strap 101, the forward forces applied to finger 61 severely load the fasteners 25 and in certain cases on rapid drawing could bend the spring assembly 24 sufficiently that the finger 61 no longer extends clearly through the hole 62 but rubs against its front edge. This dual restraint in the form of the spring of assembly 24, its overriding leather and the strap 101 provides a truly effective control of the finger 61.

Figure 19:
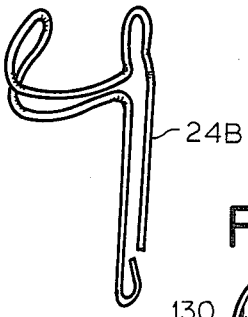
FIGS. 19 and 20 are perspective views of alternate embodiments of the restrainer spring assembly of this invention.
Figure 20:
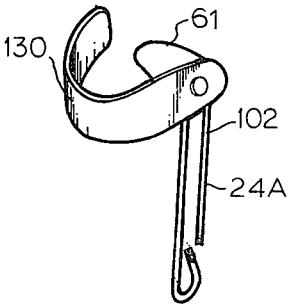

In the embodiment shown in FIG. 17, the strap itself is employed to restrain the member 61 from forward movement. The leather of strap 101 being effective for this purpose. Two other alternate embodiments likewise may be used to achieve the same purpose. They are illustrated in FIGS. 18 and 19 respectively. In FIG. 20, the assembly 24 includes an internal flat spring 130 in a generally J shape with the upper end of the J secured to the member 61 and spring 102. The hook of the J is configured to embrace the rear of the holster and by its own spring tension remain in place. This type of restraint is truly effective against front movement of the member 61 and eliminates the need for the fastener 120 of FIGS. 16–18.

In the embodiment of FIG. 19 a wire spring form 24B is used to reinforce the leather of strap 101. This wire form is produced as a continuation of the spring 102. Thus a single complex wire form serves the multiple purposes of providing the primary spring and support for member 61 and also restraining member 61 from forward movement when the hand gun is removed.

Figure 21:
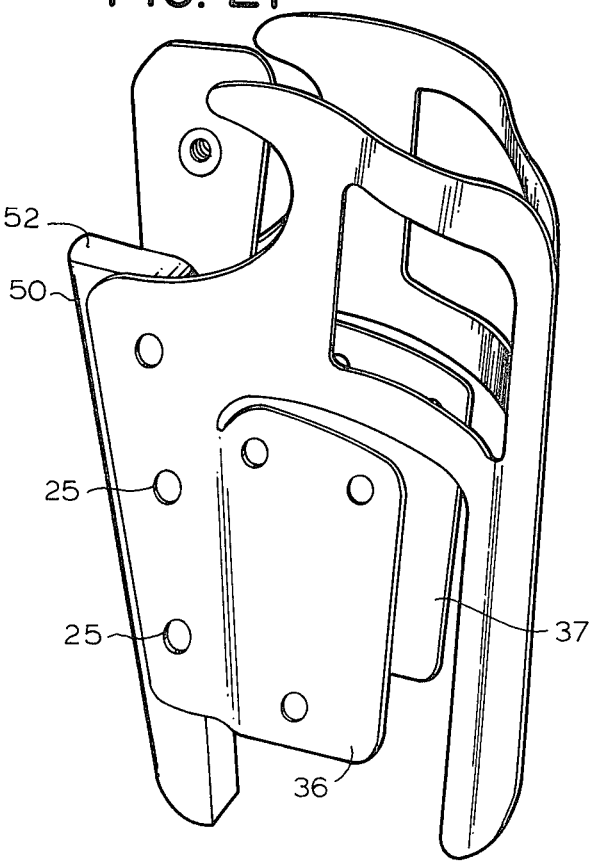
FIG. 21 is a perspective view of the main body spring assembly of the preferred embodiment of this invention.

Another feature of this invention is best shown in FIG. 21. This is the spring assembly made up of spacer 50 and spring parts 30 and 31 with the fasteners 25 shown in place. It is shown in exploded form in FIG. 2. This spring assembly involves novelty of its own right in that it provides in one assembly all of the following functions:

(1) a welt (spacer 50) defining the thickness of the rear of the holster;

(2) a fixed rest (shelf 52) for the front of the trigger guard;

(3) a mounting plate (tabs 36 and 37) for either left or right hand holsters;

(4) a body (main body portions of 30 and 31) defining metal reinforcement;

(5) cantilevered front closure springs (42 and 43);

(6) adjustable front opening tension (screws 25)

Employing the two individual spring parts and the spacer 50, it is possible to adjust the tension on the front opening by the degree of tightness of the fasteners 25 or by the selection of a spacer 50 of different thicknesses.

The restraint upon or closing force on the holster body as a whole is defined by the size of the section 40 and 41. The resistance to opening of the lower part of the front opening is determined by the width and present absence or extent of curvature, if any of the cantilevered spring members 42 and 43. Therefore, this assembly made up of three parts accomplished each of the functions set forth above. The three parts cooperate with each other and with the leather body of the holster to define its shape, resistance to front opening, and provide graduated front opening force for any front opening holster. This same assembly provides a rigid connecting point for the locking spring assembly 24 and for the backing plate 50.

One additional spring assembly is disclosed in the drawing, FIG. 11. We have found that if a flat locking spring is desired as in FIG. 8, it can be provided by a unitary spring 162, finger 161, spacer 156, stop 152, and backing plate 160. This embodiment may be produced by molding of such material as polyamid resin, for example, Nylon. Reduced cost is achieved in the embodiment of FIG. 11 through reduced assembly and this embodiment reduces the possibility of any misallignment in assembly or in use.

Despite the availability of a front draw holster for revolvers, for several years the development of an effective holster for automatic weapons with no cylinder has defied accomplishment. It is believed that this invention now achieves that goal.

The above described embodiments of this invention are merely descriptive of its principles and are not to be considered limiting. The scope of this invention instead shall be determined from the scope of the following claims, including their equivalents.

We claim:

1. A front opening holster for use with handguns comprising:

a body of leather or leather-like material defining a weapon pouch and including portions defining a top opening for the insertion of a handgun into the holster and a front opening of sufficient length to allow the withdrawal of a handgun through the front opening;

resilient means biasing the front opening to substantially closed position and responsive to withdrawal forces applied to the handgun to allow the opening of the front opening and allowing the portions of a handgun contained within the holster to pass therethrough;

obstruction means secured to and mounted with respect to said body and positioned to enter the finger guard of the handgun when a handgun is located in its normal carrying condition within the holster;

said obstruction means being configured including a beveled surface on the upper side thereof whereby insertion of a handgun into the holster by the top opening allows the displacement of the obstruction means temporarily;

said obstruction means configured to substantially prevent the removal of a handgun through the top opening wherein said obstruction means includes a second beveled surface allowing the displacement of said obstruction means when handgun removal forces are applied to the handgun in the direction of the front opening of said holster.

2. The combination in accordance with claim 1 wherein said obstruction means includes a non-beveled lower surface which engages the interior of the trigger guard when a handgun is in position within the holster.

3. The combination in accordance with claim 2 wherein said obstruction means which includes a downward extending hook portion at the outward extremity thereof or hooking over the trigger guard of a handgun when in holding condition within said holster.

4. The combination in accordance with claim 1 wherein said first and second beveled surfaces constitute a single continuous curve surface.

5. The combination in accordance with claim 1 wherein said obstruction means is resiliently mounted with respect to the holster body and passes through an opening therein in the region of the trigger guard when a handgun is located in the holster.

6. The combination in accordance with claim 5 wherein said obstruction means is mounted on said holster by a spring.

7. The combination in accordance with claim 1 including holster stiffening means positioned on the opposite side of said holster body from said obstruction means whereby a handgun when inserted in or withdrawn from the holster has its trigger guard portion engaged between the stiffened holster body on one side and the obstruction means on the opposite side whereby insertion or withdrawal of a handgun occurs with minimum distortion of the holster body and minimum sideward deflection of the handgun due to said obstruction means.

8. The combination in accordance with claim 7 wherein said mounting means for said resilient member comprises a spring having selective deflection properties favored in the outward and frontward directions.

9. The combination in accordance with claim 8 wherein said mounting means constitutes a wire spring formed into an interrupted loop configuration with the interruption in the region of the loop extending toward the front opening of the holster.

10. The combination in accordance with claim 9 wherein said spring means includes a pair of end loop portions one of said loop portions securing said spring to said holster body and the second of said end loop portions securing said obstruction means to said spring member.

11. The combination in accordance with claim 10 wherein said welt, holster stiffener and spring member constitute a unitary member.

12. The combination in accordance with claim 11 wherein said stiffening member and welt constitute a single unitary member.

13. The combination in accordance with claim 12 wherein said last member is formed of resilient plastic material.

14. The combination in accordance with claim 11 wherein said member defines a generally U-shaped structure with said stiffening member of greater thickness than said spring element portion thereof.

15. The combination in accordance with claim 14 wherein said obstruction member is formed integrally therewith.

16. The combination in accordance with claim 1 wherein said obstruction means is resiliently mounted from said holster body via a spring which is secured to a relatively rigid welt of said holster.

17. The combination in accordance with claim 16 including holster stiffening means secured to said holster body the opposite side from said obstruction means;

said stiffening member secured to said relatively stiff welt.

18. The combination in accordance with claim 17 wherein said stiffening member is a flat metal plate of sufficient stiffness so as to produce minimum deflection when upon withdrawal or insertion of the weapon in the holster.

19. The combination in accordance with claim 18 wherein said stiffening member obstruction means mounting therefor and welt define a normally closed jaw which is openable by displacement of said obstruction means.

* * * * *